US006083067A

United States Patent [19]

McCredie

[11] Patent Number: 6,083,067

[45] Date of Patent: Jul. 4, 2000

[54] SWIMMING AID

[75] Inventor: Donald McCredie, Avalon Beach, Australia

[73] Assignee: Hydro Surfing Products Pty Ltd, Avalon Beach, Australia

[21] Appl. No.: 09/242,517

[22] PCT Filed: Aug. 19, 1997

[86] PCT No.: PCT/AU97/00528

§ 371 Date: May 3, 1999

§ 102(e) Date: May 3, 1999

[87] PCT Pub. No.: WO98/07473

PCT Pub. Date: Feb. 26, 1998

[30] Foreign Application Priority Data

Aug. 19, 1996 [AU] Australia ..... PO 1725

[51] Int. Cl.[7] ..... B63C 9/08

[52] U.S. Cl. ..... 441/129; 441/65

[58] Field of Search ..... 472/129; 441/129, 441/130, 132, 135, 136, 65

[56] References Cited

U.S. PATENT DOCUMENTS

| | | | |
|---|---|---|---|
| 1,829,090 | 10/1931 | Harris | 441/129 |
| 4,886,476 | 12/1989 | Brocone et al. | 441/65 |
| 5,518,429 | 5/1996 | Gravlin . | |

FOREIGN PATENT DOCUMENTS

| | | |
|---|---|---|
| 63132/80 | 4/1981 | Australia . |
| 291 012 | 6/1991 | German Dem. Rep. . |

*Primary Examiner*—Ed Swinehart

*Attorney, Agent, or Firm*—Marshall, O'Toole, Gerstein, Murray & Borun

[57] ABSTRACT

A flotation device (1) having at least two generally elongate buoyant pontoons (2 and 3) joined by a bridging portion (5) of reduced thickness relative to the thickness of said pontoons.

8 Claims, 3 Drawing Sheets

SWIMMING AID

TECHNICAL FIELD

The present invention relates to training aids used for swimming, in particular kickboards and pull buoys.

BACKGROUND ART

For many people who use swimming pools for lap swimming, swimming training or learning to swim, a device such as a floating kickboard is used to hold in front of the body to allow the isolation of the upper body so the person can propel themself through the water by kicking the legs only. These kickboards are usually square and cumbersome and non-hydrodynamically shaped.

Swimmers also use a peanut-shaped floating device to place between their thighs which isolates their legs allowing the user to concentrate on arm stroke correction. These devices can be uncomfortable and sharp or small and non-floating.

DISCLOSURE OF THE INVENTION

The present invention seeks to overcome or at least ameliorate the problems associated with these prior art devices by providing a flotation device which can function as a kickboard and a leg floating device in one.

According to one aspect, the present invention provides a flotation device having at least two generally elongate buoyant pontoons joined by a bridging portion of reduced thickness relative to the thickness of said pontoons, wherein said bridging portion is provided with a pair of opposed generally concave cavities which taper in width towards one end of the device and provide said reduced thickness.

For preference, the pontoons are joined at or adjacent the one end by said bridging portion extending partway along the length of said pontoons. Preferably, the device is tapered towards said one end in both the vertical and horizontal planes.

In one preferred form of the invention, a "boomerang" or V-shaped flotation device is formed by two opposing pontoons which taper in both the vertical and horizontal planes to join at the front or nose of the device. The nose takes the shape of a diminishing convex style where the pontoons meet and join together. The nose at which the pontoons meet and diminish continues in the same shape along the inner opposing sides of each pontoon to define a pair of opposed concave cavities extending partway along each pontoon from the nose. This concavo-concave section bridging portion allows the user's thighs to fit snugly and comfortably when the device is placed between the thighs. The device can be made from any suitable buoyant material such as polystyrene foam, poly(ethylene-co-vinyl acrylate) (EVA) or polyethylene. It will be appreciated that other means could be used to provide buoyancy, for example, air containing chambers and the like.

BRIEF DESCRIPTION OF THE DRAWINGS

A preferred embodiment of the invention will now be described, by way of example only, with reference to the accompanying drawings in which.

BEST MODE FOR CARRYING OUT THE INVENTION

Figure 1:
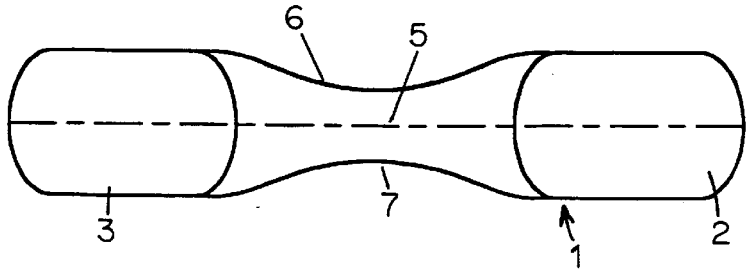
FIG. 1 shows a rear elevation view of the flotation device according to one embodiment of the invention.
Figure 2:
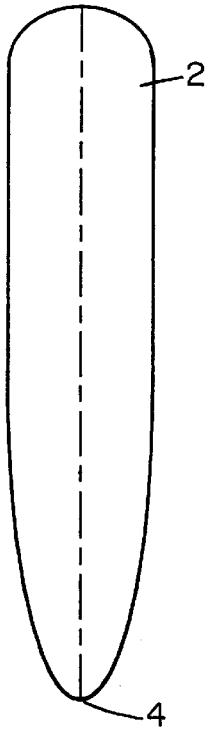
FIG. 2 shows a side view of the flotation device of FIG. 1
Figure 3:
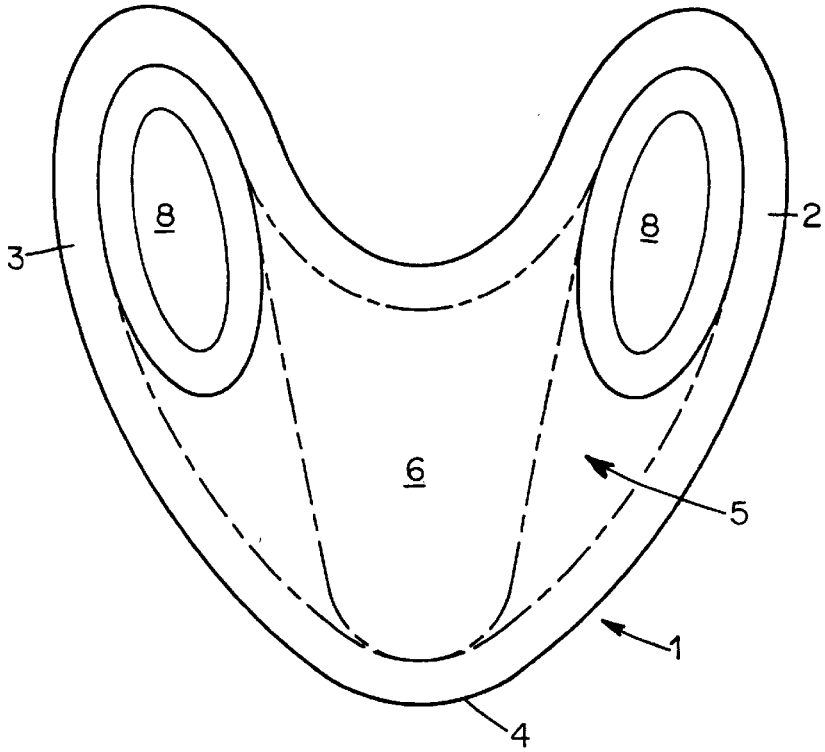
FIG. 3 shows a plan view of the flotation device of FIG. 1.
Figure 4:
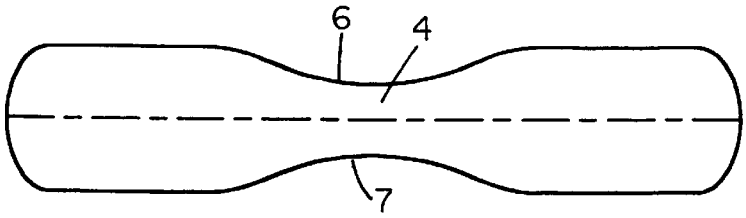
FIG. 4 shows a front elevation view of the flotation device of FIG. 1.
Figure 5:
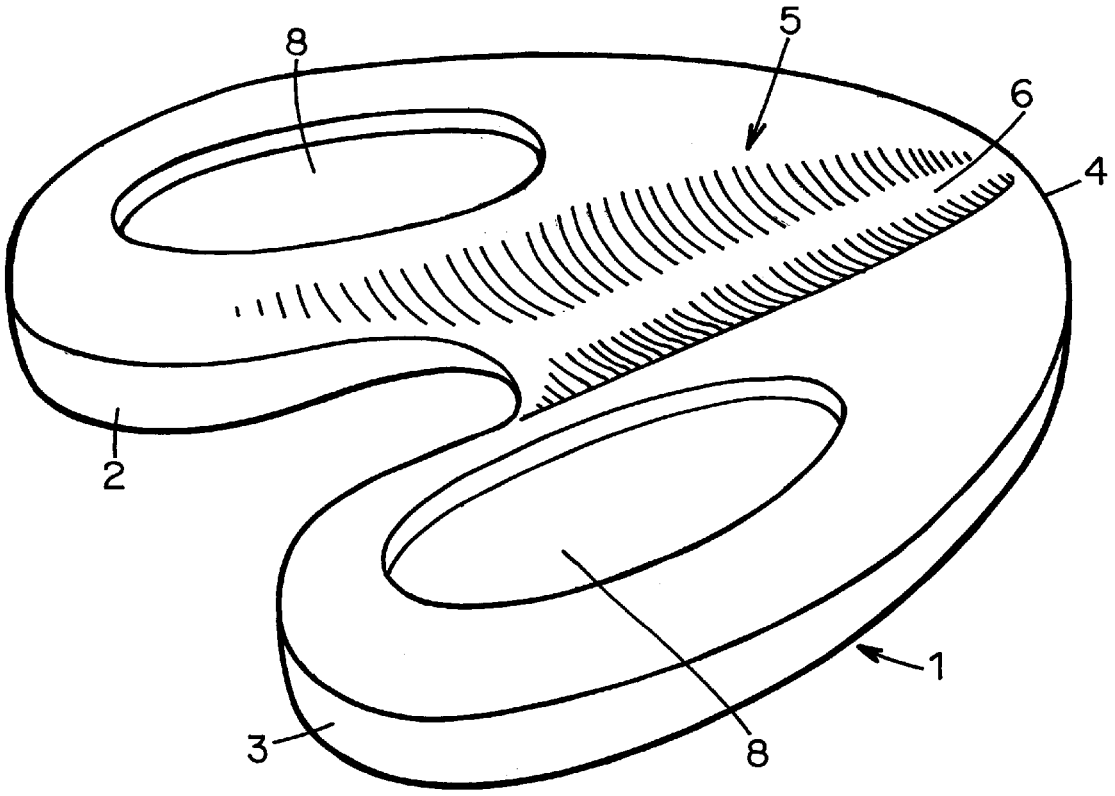
FIG. 5 shows a perspective view of the flotation device of FIG. 1.

Referring to FIGS. 1 to 5, the flotation device 1 comprises two pontoons 2 and 3 meeting at a common tapered point 4 and joined by a bridging portion 5. The taper continues part way down each inner opposed side of pontoons 2 and 3 to define a pair of opposed concave cavities 6, 7 in each opposed side of the bridging portion 5. The cavities 6 and 7 taper inwardly in width and depth towards the nose 4 of the device as best shown in FIG. 5. A pair of opposed depressions 8 are provided in the upper and underside surfaces of each free end of the pontoons 2 and 3. These depressions provide gripping means for the device in use. The device 1 is generally symmetric about its vertical and horizontal central axes.

The device is typically moulded from a buoyant material, such as polystyrene foam, in two symmetric sections about the horizontal axis and then joined by an appropriate adhesive.

Figures 6A, 6B:
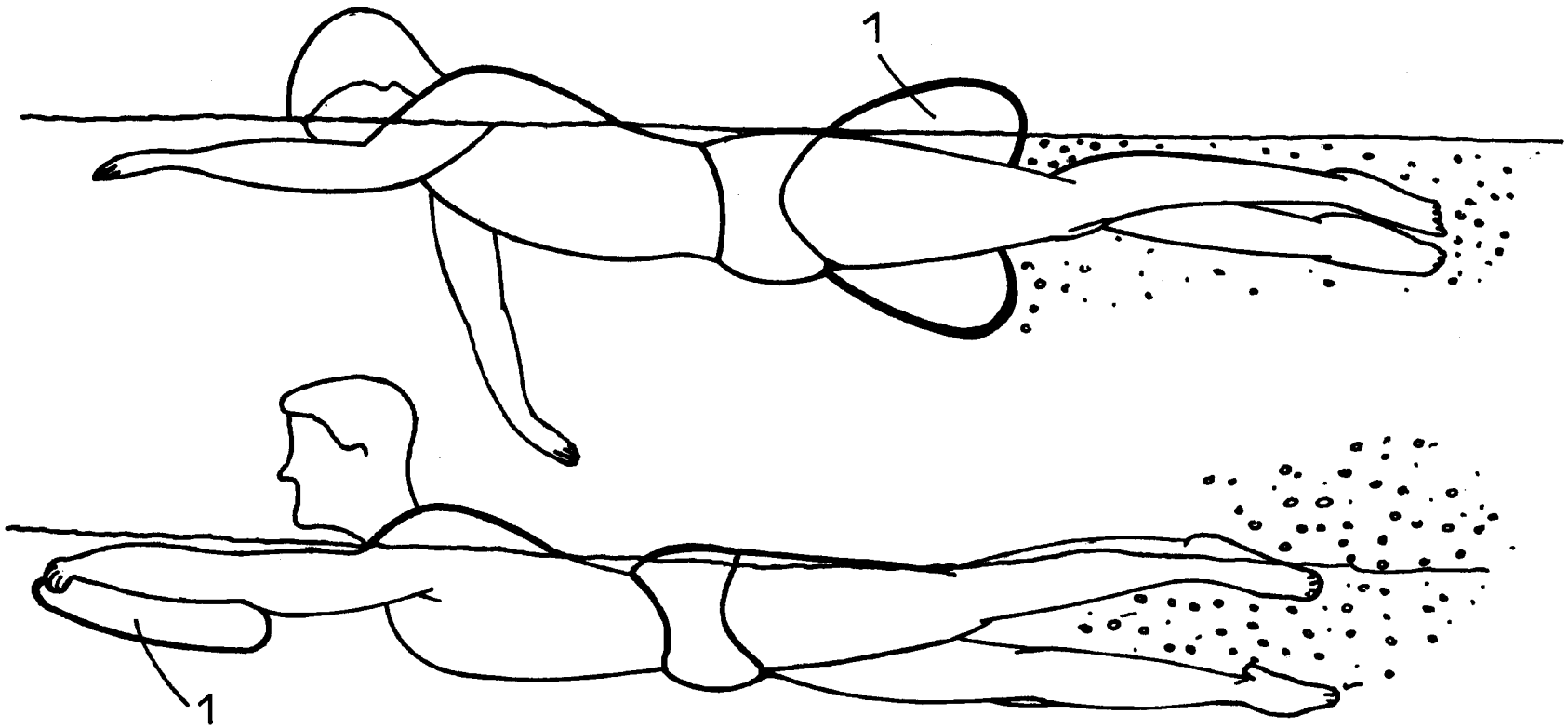
FIGS. 6(*a*) and (*b*) show the application of such a device by a user in the two basic positions.

The device is ergonomically-shaped to be used in front of the body and to create less drag or water resistance than conventional similar devices. Also when placed between the thighs it offers maximum flotation and comfort and less resistance for the user. FIGS. 6(*a*) and 6(*b*) show the device in use as a pull buoy and kickboard, respectively.

What is claimed is:

1. A flotation device having at least two generally elongate buoyant pontoons joined by a bridging portion of reduced thickness relative to the thickness of said pontoons, wherein said bridging portion is provided with a pair of opposed generally concave cavities which taper in width towards one end of said device and provide said reduced thickness, said pontoons are joined at or adjacent said one end by said bridging portion which extends partway along the length of said pontoons, the device is tapered towards said one end in both the vertical and horizontal planes to define a nose of the device, and said opposed generally concave cavities taper in depth towards said nose.

2. A flotation device according to claim 1 wherein free ends of said pontoons are provided with gripping means.

3. A flotation device according to claim 2 wherein the gripping means comprise opposed depressions formed in surfaces of said pontoons adjacent their free ends.

4. A flotation device according to claim 1 wherein the device is formed from a buoyant material.

5. A flotation device having at least two generally elongate buoyant pontoons joined by a bridging portion of reduced thickness relative to the thickness of said pontoons, wherein said bridging portion is provided with a pair of opposed generally concave cavities which taper in width towards one end of said device and provide said reduced thickness, said pontoons are joined at or adjacent said one end by said bridging portion which extends partway along the length of said pontoons, and the device is generally v-shaped in configuration and symmetric about its vertical and horizontal central axes.

6. A flotation device according to claim 5 wherein free ends of said pontoons are provided with gripping means.

7. A flotation device according to claim 6 wherein the gripping means comprise opposed depressions formed in surfaces of said pontoons adjacent their free ends.

8. A flotation device according to claim 5 wherein the device is formed from a buoyant material.

* * * * *